United States Patent [19]

LaZebnik et al.

[11] Patent Number: 4,657,478

[45] Date of Patent: Apr. 14, 1987

[54] LOW PROFILE SHROUDED FAN SYSTEM

[75] Inventors: Robert H. LaZebnik; Frank E. Breining; Martin J. Toland, all of Jackson, Mich.

[73] Assignee: Airmaster Fan Company, Jackson, Mich.

[21] Appl. No.: 803,432

[22] Filed: Dec. 2, 1985

[51] Int. Cl.[4] ..... F04D 29/60

[52] U.S. Cl. ..... 415/126; 98/42.07; 248/674

[58] Field of Search ..... 415/126, 219 R; 416/246; 98/42.07; 248/674, 667; 417/360

[56] References Cited

U.S. PATENT DOCUMENTS

| | | | |
|---|---|---|---|
| 1,445,946 | 2/1923 | Hillix | 248/674 |
| 1,474,604 | 11/1923 | Nielsen | 248/674 |
| 1,929,688 | 10/1933 | Hirschman | 98/42.07 |
| 2,332,552 | 10/1943 | Belanger | 98/43 |
| 2,385,152 | 9/1945 | Morrison | 417/362 |
| 2,485,356 | 10/1949 | Brown et al. | 415/146 |
| 2,496,773 | 2/1950 | Brown | 98/42.07 |
| 2,619,021 | 11/1952 | Pfautsch | 98/42.07 |
| 2,900,892 | 8/1959 | Shepherd | 98/43 |
| 2,980,007 | 4/1961 | Breidert | 98/43 |
| 3,202,081 | 8/1965 | Cook | 98/43 |
| 3,482,767 | 12/1969 | Reinkoester, Jr. | 417/362 |
| 3,620,644 | 11/1971 | McLarty | 248/674 |

*Primary Examiner*—Robert E. Garrett
*Assistant Examiner*—John Kwon
*Attorney, Agent, or Firm*—Beaman & Beaman

[57] ABSTRACT

A belt-driven fan characterized by its concise axial relationship of components. A shroud includes a planar apron and a tubular throat intersecting the apron. Linear support members attached to the apron support an electric motor and blade assembly bearing structure. The motor is mounted upon a bracket attached to the support members for selective assembly thereon between operating and shipping positions and with the bracket in the shipping position the electric motor is primarily located within the shroud throat.

11 Claims, 5 Drawing Figures

LOW PROFILE SHROUDED FAN SYSTEM

BACKGROUND OF THE INVENTION

Large capacity air flow fans for ventilation, house cooling and the like often utilize belt drives between the blade assembly and an electric motor to achieve quiet operation, proper fan blade rotational velocity and economy of manufacture.

Commonly, belt-driven ventilating fans include a tubular throat in which the blade assembly is located and the throat is associated with a shroud or housing for positioning the throat and mounting the motor and blade apparatus. Conventionally, the mounting structure for the motor and blade assembly includes U-shaped brackets attached to the fan structure in axial alignment with the throat, the U bracket configuration being necessary to provide the clearance and alignment required for the motor and fan blade structure.

The use of such U-shaped brackets adds considerable dimension to the complete fan assembly in the axial direction of the throat, and such axial length creates shipping problems and increased handling costs, as well as sometimes creating installation problems.

Various belt-driven fans are known which do not employ such U-shaped brackets, but known fan constructions which eliminate such brackets still have greater axial dimensions than is desired and such constructions do not achieve the economy of manufacture sought. Typical belt-driven fan devices of known types are shown in U.S. Pat. Nos. 2,332,552; 2,385,152; 2,485,356; 2,980,007 and 3,482,767.

It is an object of the invention to provide a belt-driven fan having a low profile in the axial direction of air movement wherein high air volumes can be achieved in a fan having a relatively small axial dimension.

A further object of the invention is to provide a belt-driven fan system utilizing a flat apron in conjunction with a tubular throat wherein support members for an electric motor are mounted on the apron substantially coplanar therewith and the same support members for the motor are used to mount the bearing structure for the blade assembly.

Another object of the invention is to provide a belt-driven fan assembly having a concise axial dimension and using an electric motor wherein the motor is mounted on a support bracket pivotal between operating and shipping positions, the shipping position of the motor bracket substantially reducing the axial dimension of the fan assembly and reducing handling costs.

In the practice of the invention the fan shroud includes a planar apron centrally intersected by a tubular throat. A pair of parallel linear angle iron support members are attached to the apron on opposite sides of the throat axis, and a bridge is disposed between the support members in alignment with the throat axis. A bearing housing mounted upon the bridge extends into the throat and includes a shaft upon which the blade assembly is mounted. Additionally, a cup-shaped pulley is mounted upon the blade shaft intermediate the bearing housing and the blade assembly.

A motor mounting bracket is also interposed between the support members adjacent the periphery of the apron. The motor bracket is adapted to receive an electric motor having a driveshaft and pulley which align with the blade shaft pulley when the motor bracket is in its operative position.

The motor bracket is removably bolted to the support members, and is of such a configuration that it may be pivoted relative to the support members to a shipping position locating the motor bracket within the confines of the support members, and locating the electric motor within the throat. In such a shipping position the axial dimension of the fan assembly is minimized to simplify boxing and crating, and minimizing shipping costs.

The components of the invention are primarily formed of sheet metal, and the arrangement of the support members, the mounting of the bearing housing for the blade assembly, and the alternate mounting of the motor bracket permits achievement of the objects of the invention without expensive fabrication techniques.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

With reference to the drawings, a low profile fan assembly in accord with the invention includes a sheet metal shroud generally indicated at 10. The shroud includes a planar apron 12 having a rectangular periphery, usually square, defined by flanges 14 disposed at right angles to the plane of the apron. The shroud also includes a cylindrical venturi throat 16 centrally located with respect to the configuration of the apron and having an axis perpendicularly disposed to the apron plane. As will be appreciated from FIG. 3, the throat 16 intersects the apron 12 tangentially at radius 18.

Figure 3:
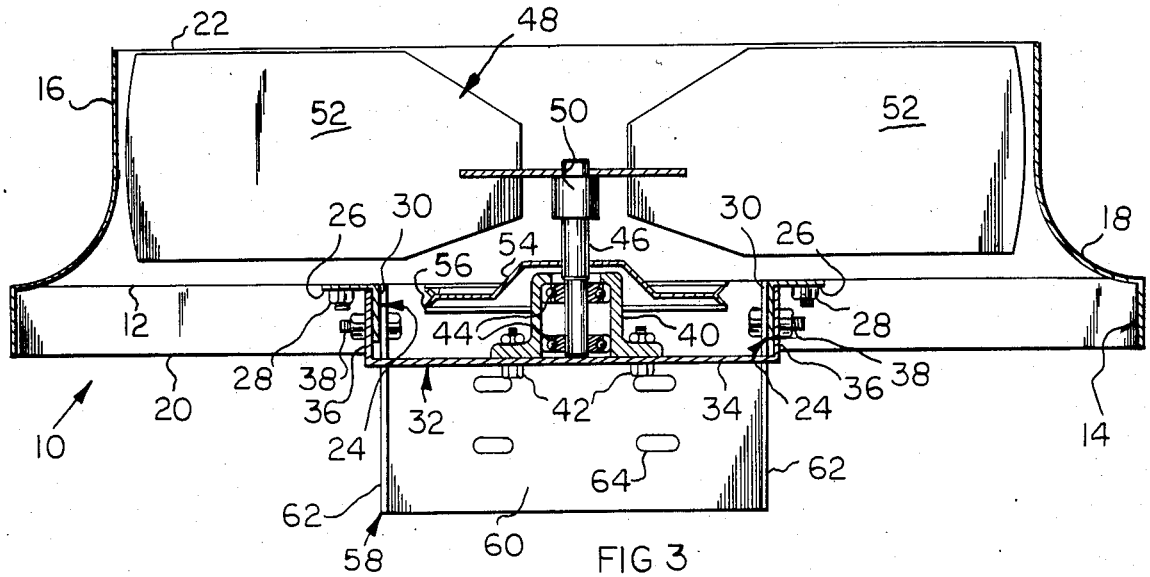
FIG. 3 is a plan, sectional view as taken along Section III—III of FIG. 1, the electric motor not being shown for clarity of illustration.

With reference to FIG. 3, it will be appreciated that the axial dimension of the shroud 10 is defined by the outer edge 20 of the flanges 14, and the circular edge 22 of the throat.

Figure 1:
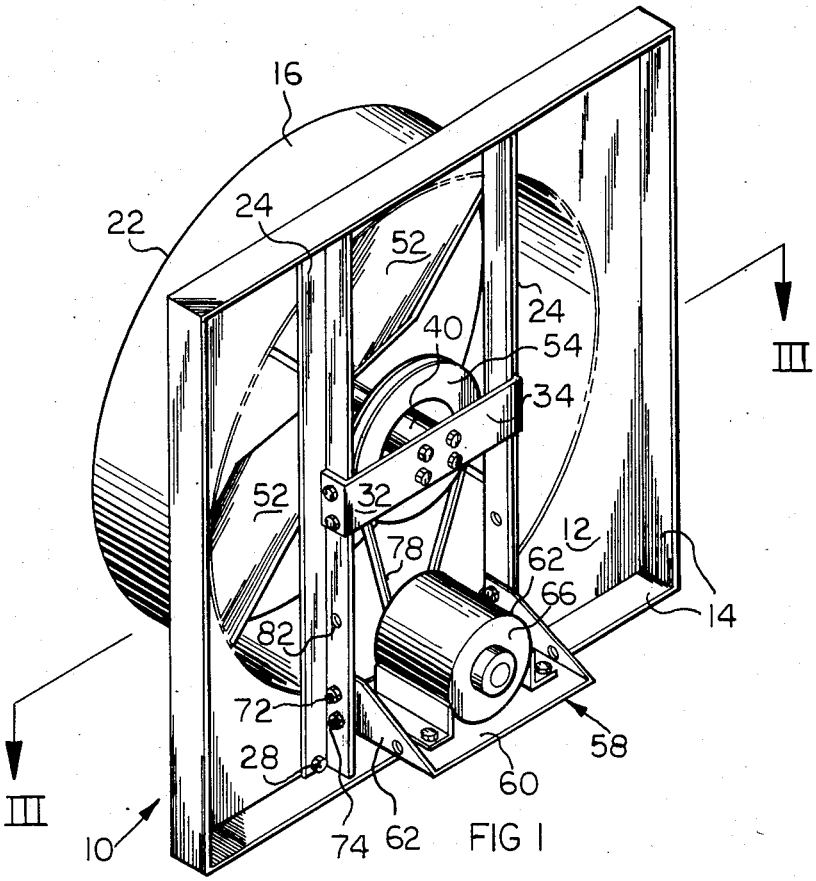
FIG. 1 is a rear perspective view of a low profile shrouded fan in accord with the invention, the motor-supporting bracket and motor being shown in the operative position.
Figure 2:
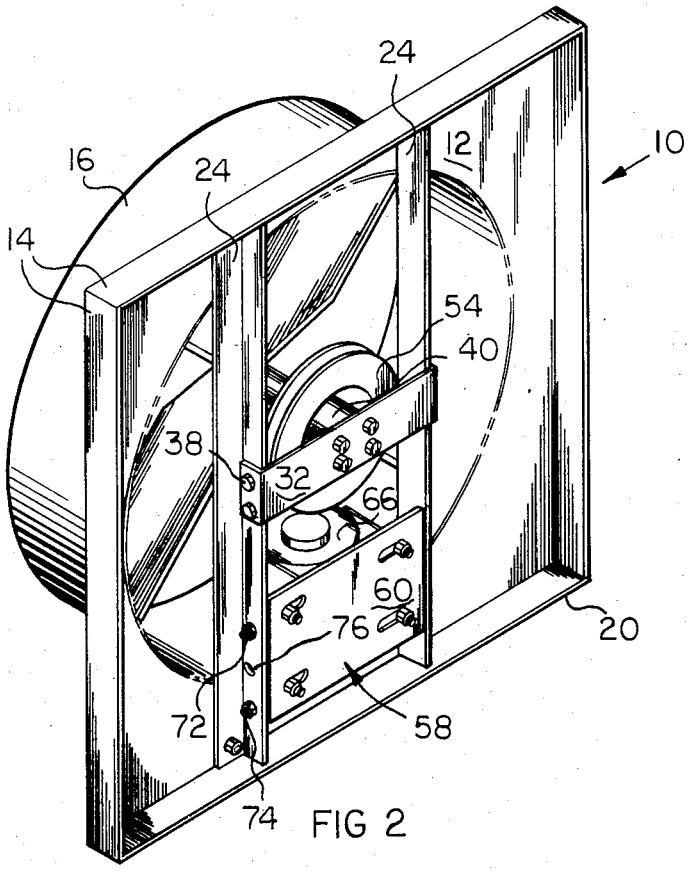
FIG. 2 is a rear perspective view similar to FIG. 1 illustrating the motor-supporting bracket and motor in the shipping position.

A pair of parallel support members 24 are mounted upon the apron 12 and extend across the throat 16 as best appreciated from FIGS. 1 and 2. The support members 24 each comprise angle iron elements having a flat base 26 engaging the plane of the apron 12 and attached thereto either by weldments or bolts 28, as illustrated. The legs 30 of the angle iron members 24 are of a dimension substantially equal to the depth of the flanges 14 and extend parallel to the throat axis. The members 24 are each offset with respect to the throat axis an equal distance opposite sides thereof and of a length to fit between the flanges 14 located on opposite sides of the apron.

A sheet metal bridge 32 is affixed to support members 24 and extends therebetween. The bridge 32 is of a U-configuration having a base 34 and legs 36. The legs 36 extend on the outer side of the support member legs 30, and are attached thereto by bolts 38. The base 34 is in alignment with the axis of the throat 16, and includes an inner side to which the bearing housing 40 is affixed by bolts 42, FIG. 3.

The bearing housing 40 is a cast member having a pair of spaced ball bearings 44 located therein for supporting the blade shaft 46 coaxial with the throat axis. The blade shaft 46, in a cantilevered manner, extends into the throat 16 and supports the blade assembly 48 consisting of a hub 50 to which are attached a plurality of fan blades 52.

A pulley 54 is affixed to the shaft 46 intermediate the hub 50 and housing 40, and as will be appreciated from FIG. 3, the pulley 54 is of a dish-configuration so that the belt groove 56 is located intermediate the configuration of the support members 24 and in radial alignment with the housing 40.

A motor bracket 58 is mounted upon the support members 24 adjacent the apron 12. The motor bracket is formed of sheet metal and is of a U-configuration having a base 60 and parallel leg flanges 62 extending in a common direction from the base. The base 60 is provided with a plurality of elongated slots 64, FIG. 4, wherein an electric motor 66 may be bolted to the base and accurately adjusted thereon in the well known manner. The electric motor includes a driveshaft 68, FIG. 5, upon which a pulley 70 is mounted.

The motor bracket 58 is of such width as to fit between the legs 30 of the angle iron support members 24, and upper bolts 72 and lower bolts 74 extend through each flange 62 through holes 76 defined in the support member legs. In this manner the use of two bolts in each leg flange of the bracket 58 permits the base 60 to be disposed in a plane at right angles to the plane of the apron 12, as shown in FIGS. 1, 3 and 4, wherein the motor shaft 68 will be parallel to the blade shaft 46 and a belt 78 mounted upon the pulleys 54 and 70 will permit the electric motor 66 to drive the blade shaft and rotate the blade assembly 48.

Figure 5:
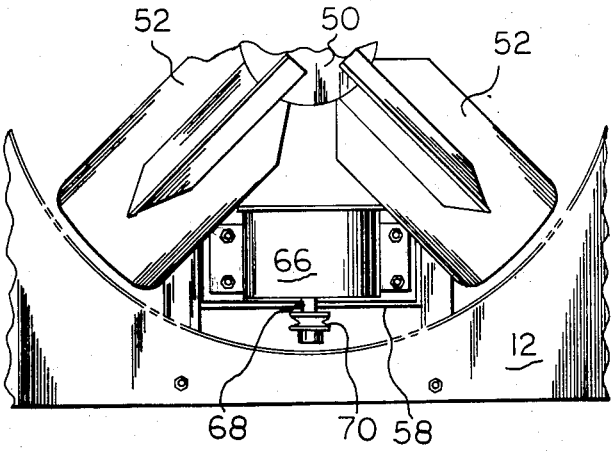
FIG. 5 is a partial, front, elevational view of the fan structure illustrating the motor in the shipping position.

By removing the upper bolts 72 the motor bracket 58 may be pivoted upwardly toward the bridge 32 and inwardly toward throat 16 about the lower bolts 74. Such a pivotal movement of the motor bracket will locate the motor 66 within the throat 16, as shown in FIGS. 2 and 5. Of course, prior to such pivoting of the motor bracket the belt 78 must be removed from the motor pulley 70.

The motor bracket 58 shipping position is as shown in FIGS. 2 and 5 and the bracket is affixed in this position by aligning the bracket leg holes 80 with the support member holes 82 and temporarily inserting the bolts 72 therein. In this position the base 60 will be substantially parallel to the plane of the apron 12 and the bracket base will be located within the confines of the support members 24. Thus, for shipping purposes, of the axial dimension of the unit will be defined by the shroud flange edge 20 and the throat edge 22, FIG. 3.

Figure 4:
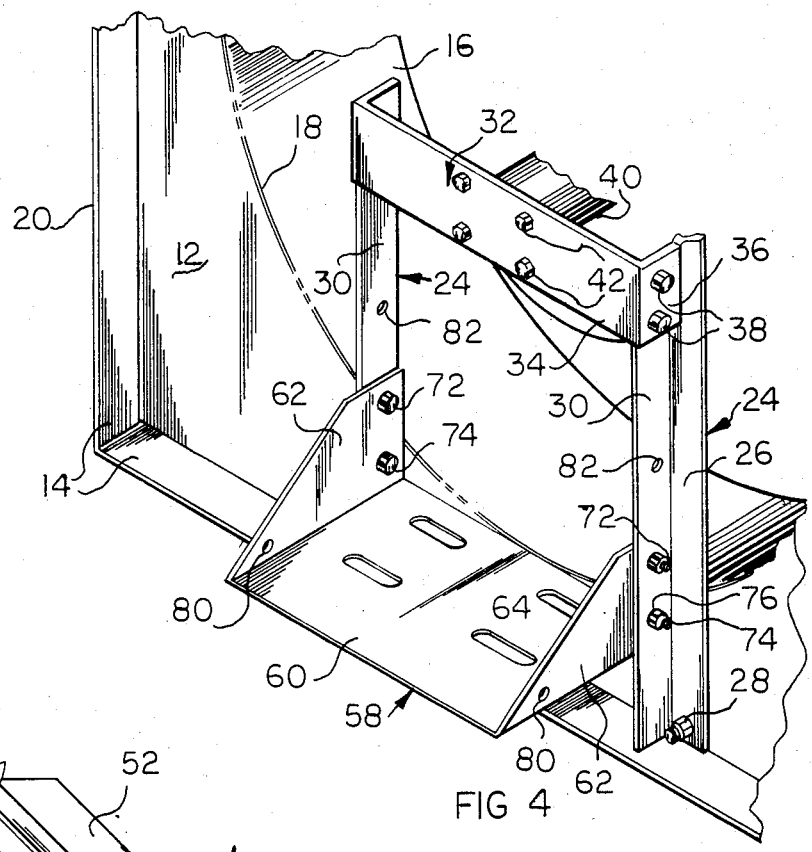
FIG. 4 is a fragmentary, enlarged, rear, perspective view illustrating the motor bracket structure.

To place the fan unit in an operative condition after shipping, it is only necessary that the bolts 72 be removed from the support member holes 82 and the bracket holes 80, and the motor bracket 58 is pivoted "outwardly" about the bolts 74, and the bolts 72 are then inserted into the upper set of holes defined in the leg flanges 62 and the upper set support member holes 76 to position the bracket as shown in FIGS. 1 and 4. The belt 78 is then placed upon the motor pulley 70 and the blade shaft pulley 54 and the unit is in condition for installation and use.

It will be appreciated that the sheet metal construction of the majority of components of the shrouded fan of the invention will reduce manufacturing costs, as will the use of angle iron members, and it is appreciated that various modifications to the inventive concepts may be apparent to those skilled in the art without departing from the spirit and scope of the invention.

We claim:

1. An axial flow fan assembly characterized by its low profile and compact arrangement of components comprising, in combination, a shroud including a substantially planar apron having a central axis, an open annular tubular throat concentric to said axis having a length subsatntially perpendicular to the plane of said apron and a periphery defined by flanges extending from the plane of said apron in a direction away from said throat, pair of substantially parallel elongated, spaced angle iron support members each having ends, fastening means attaching each support member end to said apron, said support members each lying in a plane subsatntially parallel to and adjacent the plane of said apron within the confines of said flanges and each extending across said thorat on an opposite side of said central axis, a sheet metal bridge affixed to and extending between said support members in alignment with said central axis having an inner side disposed toward said throat, a bearing housing mounted upon said bridge, bearings within said housing, a cantilever shaft rotatably supported within said bearings having an unsupported end extending into said throat and having an axis coaxial with said central axis, an axial flow blade assembly mounted on said shaft end within said throat, a first belt pulley mounted on said shaft, a sheet metal motor bracket extending between said support members and affixed thereto, an electric motor mounted upon said motor bracket having a driveshaft extending toward said throat, a second belt pulley mounted on said motor driveshaft, and a belt interconnecting said first and second pulleys.

2. In a fan assembly as in claim 1, said first belt pulley mounted on said cantilever shaft being located intermediate said blade assembly and said bridge inner side.

3. In a fan assembly as in claim 1, releasable fasteners mounting said motor bracket between said support members, and means defined upon said motor bracket selectively cooperating with said fasteners to alternately mount said motor bracket on said support members in an operative position wherein said motor driveshaft is substantially parallel to said central axis and cantilever shaft and said bracket and said motor is located exteriorly of said throat and in a shipping position wherein said motor is located within said throat and said bracket is located within the configuration of said support members.

4. In a fan assembly as in claim 3, said releasable fasteners comprising bolts, and said means defined upon said motor bracket cooperating with said fasteners comprising bolt receiving holes defined in said motor bracket.

5. In a fan assembly as in claim 1, said motor bracket comprising a U-shaped member having a base and side portions extending in a common direction from said base, said electric motor being attached to said base, bolt receiving holes defined in said support members and in said bracket side portions, bolts selectively receivable within said bolt receiving holes, said bolt holes in said side portions permitting said bolts to alternately mount said motor bracket on said support members in an operative position wherein said motor driveshaft is substantially parallel to said central axis and cantilever shaft and said bracket and said motor is located exteriorly of said throat and in a shipping position wherein said motor is located within said throat and said bracket is located within the configuration of said support members.

6. In a fan assembly as in claim 5 wherein a pivot bolt extends through each of said motor bracket side portions and support members, said pivot bolts of each side portion being in axial alignment defining a pivot axis for said motor bracket for movement thereof between said operative and shipping positions, and an anchor bolt extending through each of said motor bracket side portions and support members when said motor bracket is in said operative position.

7. An axial flow fan assembly characterized by its low profile and compact arrangement of components comprising, in combination, a shroud including a substantially planar apron having first and second sides, a central axis, a periphery, and an annular open tubualr throat concentric to said axis extending from said apron first side having a length substantially perpendicular to the plane of said apron, a flange defined upon said apron periphery transversely extending from said apron second side, a pair of spaced parallel linear support members affixed to said apron second side between said flanges, said members being on opposite sides of said central axis, a bridge affixed to and extending between said support members in alignment with said central axis having a inner side disposed toward said throat, a bearing housing mounted upon said bridge, a shaft rotatably mounted in said housing, an axial flow blade assembly mounted on said shaft and located within said throat, a first belt pulley mounted upon said shaft, a motor bracket extending between said support members in alignment with siad throat, an electric motor mounted on said motor bracket having a driveshaft, a second belt pulley mounted on said motor driveshaft, pivot means mounting said motor bracket upon said support members whereby said motor bracket may be selectively pivoted between an operative position wherein said motor bracket extends away from said throat and apron second side and a shipping position wherein said motor bracket is pivoted toward said apron second side and said electric motor is located within said throat, locking means locking said motor bracket in said operative position, and a belt interconnecting said first and second pulleys when said motor bracket is in said operative position.

8. In a fan assembly as in claim 7, said support members comprising angle iron elements.

9. In a fan assembly as in claim 7, said motor bracket comprising a U-shaped member having a base and side portions extending in a common direction from said base, said electric motor being mounted upon said base, said pivot means comprising bolts extending through said support members and said motor bracket side portions.

10. In a fan assembly as in claim 9, said locking means comprising bolts extending through said support members and said motor bracket side portions.

11. In a fan assembly as in claim 9, said motor bracket base being located between the confines of said support members when said base is in said shipping position.

* * * * *